United States Patent [19]

Dokoupil

[11] 4,142,386

[45] Mar. 6, 1979

[54] THROUGHPASS LEATHER WORKING MACHINE, ESPECIALLY AN EMBOSSING AND IRONING MACHINE

[76] Inventor: Jiri Dokoupil, Hochstrasse 9, 6251 Glückingen, Fed. Rep. of Germany

[21] Appl. No.: 852,853

[22] Filed: Nov. 18, 1977

[30] Foreign Application Priority Data

Nov. 26, 1976 [DE] Fed. Rep. of Germany ..... 2653682

[51] Int. Cl.[2] ..... E05B 67/10; B30B 3/04

[52] U.S. Cl. ..... 69/43; 100/160

[58] Field of Search ..... 69/41, 48, 43, 47, 42; 100/155, 160, 172, 176

[56] References Cited

U.S. PATENT DOCUMENTS

| | | | |
|---|---|---|---|
| 1,563,130 | 11/1925 | Weston | 100/160 X |
| 2,399,819 | 5/1946 | Moore | 69/43 |
| 2,538,086 | 1/1951 | Dennison | 69/43 X |
| 2,803,954 | 8/1957 | Bucek | 69/43 |
| 3,587,258 | 6/1971 | Plechac et al. | 69/43 |
| 4,055,059 | 10/1977 | Dokoupil | 69/41 |

*Primary Examiner*—Patrick D. Lawson

*Attorney, Agent, or Firm*—Werner W. Kleeman

[57] ABSTRACT

A throughpass leather working machine, especially an embossing and ironing machine for leather which comprises at least one substantially tubular-shaped, thick-walled leather working element in the form of an embossing and/or ironing element which at both ends at the outer surface thereof and externally of the embossing or ironing zone has substantially cylindrical bearing or contact surfaces at which there are exerted by means of rollers or open rolling-contact bearings embossing or ironing forces. These forces are transmitted by means of the embossing or ironing zone to the surface of the leather piece which is being processed. The leather pieces are supported and transported by elastic support means and at least one counter-pressure roll.

17 Claims, 8 Drawing Figures

THROUGHPASS LEATHER WORKING MACHINE, ESPECIALLY AN EMBOSSING AND IRONING MACHINE

BACKGROUND OF THE INVENTION

The present invention relates to a new and improved construction of a continuous or throughpass leather working machine, especially an embossing and ironing machine for leather having at least one leather working element, particularly an embossing and/or ironing element in the form of a heated tube.

During the finishing of leather the production of an artificial, plastic (three-dimensional) surface at the leather (the so-called embossing operation) is an important working step. Up to now in practice this work was carried out in the tannery by means of large hydraulic pressing machines. These pressing embossing machines press large surface-steel embossment plates, during a cyclic operation and at high pressure and temperature, into the surface of the leather. The expenditure in work for this operation is extremely high because the pressing embossing work in a cyclic operation requires a great amount of time for closing the work space or compartment, to build-up pressure, for heating the leather, and again for opening the work compartment.

Up to now all attempts to overcome these drawbacks have failed to practice. The reason for this lack of success is primarily the cost outlay for the embossing elements in the form of embossing rolls which must be heated extremely well. Also the possibility of rapidly and simply exchanging such embossing rolls is an important factor in the tannery. There are completely different prerequisites for such embossing work when performed in a tannery than, for instance, in plants which process plastics where an embossed surface is applied by calenders to meter-long plastic webs which are available in large quantitites. During the operation of a tannery the adaptability of a pressing embossing machine should be extremely high. The actual embossing elements should be relatively economical in price, because the tannery processes large numbers of different patterns.

Different attempts have been made to solve these problems. Thus, for instance, in German Patent application No. P 22 45 018.6 there is disclosed an embossing surface in the form of a hollow roll which is heated from the outside and inside by means of a radiant heater. The embossing pressure is applied by means of one or a number of pairs of rolls, and of each roll pair one such roll is arranged outside and the other inside the hollow roll. Apart from certain advantages which can be realized with this equipment, nonetheless these machines are associated with the disadvantage that the hollow roll must have a relatively large diameter, so that it is possible to internally arrange the counter-pressure roll and the heater. The relatively thin wall of the hollow roll also causes difficulties when fabricating the embossing surface. Machines of this construction are therefore not extremely suitable for performing the actual embossing work.

In German Patent application P No. 25 43 526.1 there is proposed a solution wherein the embossing surface is arranged in the form of a long tube between two pairs of rolls or between one roller pair and a roll. These rolls support the roll-shaped embossing body against bending-through and which embossing body internally has an extremely small diameter. Between the rolls and the roll-shaped embossing body there are arranged elastic transport bands or belts which serve to transmit the embossing force from the roll-shaped embossing body to the support rolls and thus protect the embossing surface. In order to heat the leather there is provided a contact heater which, however, is located completely separate from the embossing zone at the infeed transport band where the leather, during its movement, is pressed against a smooth heated surface and is thus preheated. With this arrangement it would be possible to produce price worthy embossing elements. However a drawback which exists with such solution is that the comparatively small diameter of the tubular-embossing element does not permit installation of any efficient radiant heater, something necessary in practice. A further drawback associated with the small diameter of the embossing element is that during the embossing work the leather tends to adhere to the surface of the roll, and thus, the operator, with such small diameter of the embossing element, has too little time and possibility to tear away the adhering starting portion of the leather from the roll surface. Supporting the embossing tube with the aid of a second felt band is effective, yet however has the disadvantage that such proposal appreciably complicates the construction of the machine, quite apart from the wear exerted upon such support bands.

SUMMARY OF THE INVENTION

Hence it is a primary object of the present invention to provide an improved construction of leather working machine which is not associated with the aforementioned drawbacks and limitations of the prior art proposals.

Another and more specific object of the present invention aims at the provision of a novel construction of leather working machine suitable for working leather in a throughpass operation, and further, manifesting itself by its high operating speed and reduced work expenditure and basically capable of also ironing i.e. smoothing the leather.

Still a further significant object of the present invention aims at a new and improved construction of a throughpass embossing and ironing machine for leather which is relatively simple in construction and design, extremely economical to manufacture, highly efficient in operation, not readily subject to malfunction or breakdown, requires a minimum of servicing and maintenance, and operates at a high working speed.

Now in order to implement these and still further objects of the invention, which will become more readily apparent as the description proceeds, the leather working machine of the present development is manifested by the features that it possesses at least one substantially tubular-shaped thick-walled leather working element in the form of an embossing and/or ironing element having at both of its ends, at the outer surface thereof, and externally of the embossing or ironing zone of such leather working element, substantially cylindrical bearing or contact surfaces. By means of rollers or open roller-contact bearings there are exerted embossing or ironing forces against such contact surfaces. The embossing or ironing forces are transmitted by means of the embossing or ironing zone to the surface of the leather piece which is being processed. The leather pieces are supported and transported by means of elastic support means, for instance a transport band or belt formed of felt, and at least one counter-pressure roll.

In the internal space of the tubular-shaped embossing or ironing element there are advantageously arranged rolls adjacent the radiant heater. These rolls serve for the support and transport of the embossing or ironing element during its replacement or exchange. Such rolls are mounted at the region of the contact surfaces to be slidably displaceable or downwardly tiltable, so that when tilting or displacing such rolls the tubular-embossing or ironing element is seated at the inner contact rolls which are arranged with their axis of rotation essentially perpendicular i.e. at right angles to the axis of rotation of the embossing or ironing element, and the embossing or ironing element can be easily and rapidly transported out of the machine.

In the case of larger working widths the counter-pressure roll is pressed by means of further pressure or contact rolls against the tubular-shaped embossing or ironing element and in this manner there are eliminated the different pressures in the pressure zone. For this constructional solution it is extremely advantageous if the counter-pressure roll has an appreciably smaller amount of resistance and static moment of inertia than the tubular-shaped embossing or ironing element. The pressure rolls act by means of hydraulic pressure means against the counter-pressure roll. There is achieved the beneficial result that notwithstanding an unavoidable bending-through of the long tubular-shaped embossing or ironing element and bending-through of the counter-pressure roll there is present an extensively constant pressure in the embossing zone as such is required for a uniform embossing pattern or printing effect.

For extremely large working widths, for instance entire hides or skins, there is particularly suitable a modified construction where there are provided individual embossing or ironing stations, for instance three to five over the entire work width, consisting of individual substantially tubular-shaped embossing or ironing elements and associated counter-pressure rolls. These stations are distributively arranged in a checkerboard-like manner over the working width such that during throughpass of entire hides or skins they cover the entire surface thereof.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
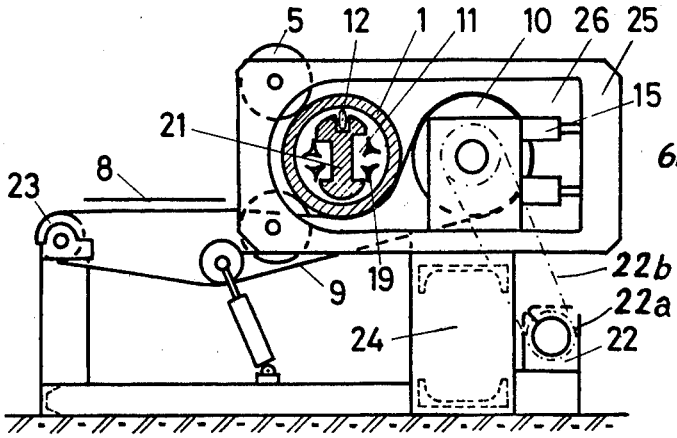
FIG. 1 is a schematic side view of an embodiment of embossing and ironing machine capable of handling smaller working widths of the leather or leather pieces being processed.

Describing now the drawings, with the exemplary embodiment of leather working machine, specifically the embossing and ironing machine as shown in FIG. 1, there is provided a substantially tubular-shaped leather working element in the form of an embossing and/or ironing element 1, —sometimes hereinafter simply referred to as embossing element 1— having an inner space or compartment 11. Within this inner space or compartment 11 there is arranged a carrier or support 21 which is fixedly connected by any suitable connection elements 24*a* with the machine frame 24. Upon this support 21 there are attached the internal radiant heaters or heater means 19 and at such support or carrier 21 there are also rotatably mounted the inner or internal rollers or rolls 12.

The leather working element, here in the form of the embossing and/or ironing element 1, is pressed by means of the bearing or contact rolls 5 against a felt band or belt 9 and the counter-pressure roll 10. These contact or bearing rolls 5 are here dispositioned at the region of both opposed ends 1*a* of the thick-walled embossing or ironing element 1 at the outer surface thereof and externally of the embossing or ironing zone, generally designated by reference character 3. The contact or bearing rolls 5 act upon the substantially cylindrical bearing or contact surfaces 4 at the opposed ends of the outer surface of the embossing or ironing element 1 and located externally of the aforementioned embossing or ironing zone 3 thereof. What is meant by "thick walled" as applied to the embossing and/or ironing element 1 is that it is rigid or stiff in the peripheral direction thereof. The embossing pressure is produced by the hydraulic means 15 which act upon the counter-pressure roll 10. This counter-pressure roll 10 is driven by the drive means 22, for instance constituted by a drive motor 22*a* and associated power transmission element, for instance a sprocket chain 22*b* or the like.

Figure 1A:
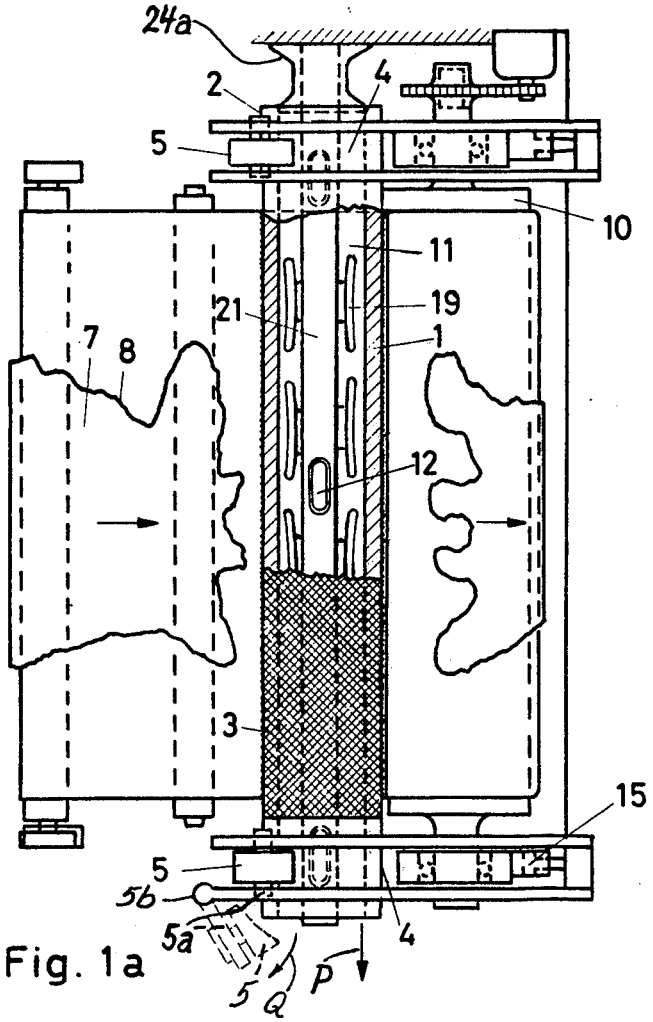
FIG. 1*a* is a top plan view of the leather working machine shown in FIG. 1.

At the movable side portions 25 of the machine frame 24 there is formed an opening 26 by means of which it is possible to exchange the embossing or ironing element 1 by transporting such laterally in the direction of the arrow P out of the machine. For this purpose the bearing or contact rolls 5 are laterally shifted away, for instance by displacing or tilting the roll amounts 5*a*, for instance in the direction of the arrow Q about axis 5*b* into the phantom line position shown in FIG. 1a. The embossing element 1 then is seated upon the inner bearing rolls 12 and can be easily transported out of the machine, for instance upon a hydraulic fork lift device arranged laterally of the machine, the forks of which are equipped with bearing rolls in a similar configuration as the support 21. The leather pieces 8 which are processed in the machine are transported by means of an elastic support means, such as the felt band or belt 9 or any other suitable transport means into the machine, the felt band 9 being deflected in conventional manner by means of the deflection rolls 23 and equipped with any suitable tensioning device and automatic guide device.

Figure 2:
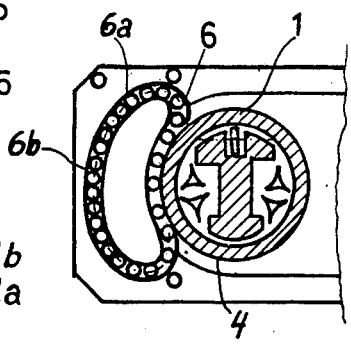
FIG. 2 is a fragmentary view illustrating a modified construction of the means for imparting the leather working-pressure by open rolling-contact bearings.

Now in FIG. 2 there is shown a variant construction wherein the pressure is exerted upon the tubular-shaped embossing or ironing element 1 by an open rolling-contact bearing means or bearings 6 composed of rolling-contact bearing elements 6a which move in a guide track 6b, with only part of the contact surface of the embossing element contacted by the bearing elements 6a. The use of such special bearings has the advantage of distributing the contact pressure.

Figure 3:
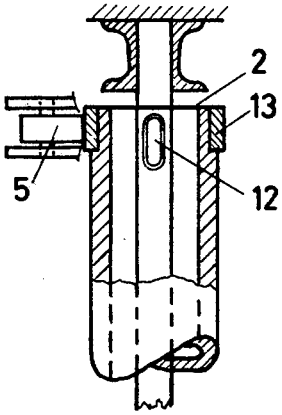
FIG. 3 is a fragmentary view showing details of the races or bearing rings.

As also mentioned, it is advantageous to construct the contact or bearing surfaces 4 of the tubular-shaped embossing or ironing element 1 as exchangeable races or bearing or contact rings 13, as the same has been illustrated in FIG. 3.

Figure 4:
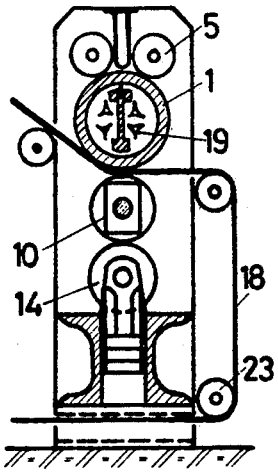
FIG. 4 is a side view of a further embodiment of a leather working machine capable of handling large working widths wherein the pressure is imparted by pressure rolls.
Figure 4A:
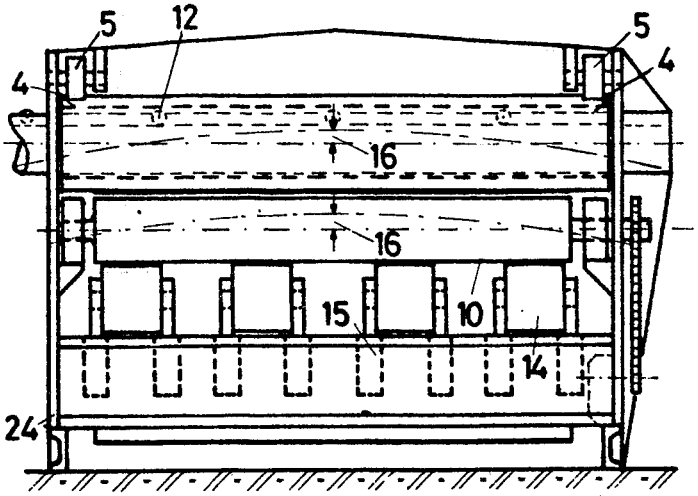
FIG. 4*a* is a front view of the leather working machine shown in FIG. 4.

When operating with larger working widths where there is no longer possible a compensation of the varying embossing or ironing pressure — the difference of the ironing pressure exists due to bending-through of the embossing or ironing element 1 and the counter pressure roll 10 — by cambering or arching the counter-pressure roll 10, the application of the pressure can be realized through the use of a number of pressure of contact rolls 14, as best seen by referring to FIG. 4. These pressure rolls 14 act upon the counter-pressure roll 10 by means of hydraulically produced forces, exerted by the hydraulic drives 15. With this constructional arrangement there is achieved the beneficial result that the tubular-shaped embossing or ironing element 1 and the counter-pressure roll 10 bend-through in one direction, namely the direction indicated by reference character 16. It is thus possible to also achieve the advantageous result that the embossing pressure remains essentially constant over the working width even with different variable pressure application, something which is only possible for certain pressure values when working with simple cambering or doming of the counter-pressure roll 10. As to this constructional variation which has been schematically shown in FIGS. 4 and 4a it is advantageous if the counter-pressure roll 10 has a considerably smaller moment of resistance and static moment of inertia than the embossing element 1.

Figure 5A:
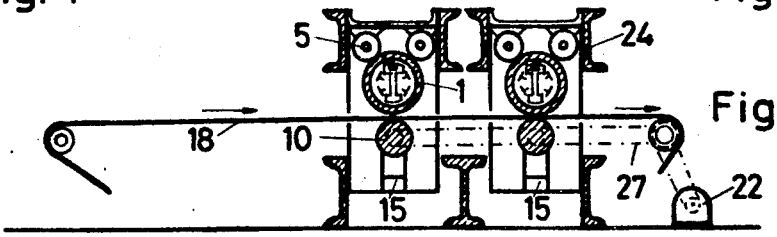
FIG. 5*a* is an end view of the leather working machine shown in FIG. 5.
Figure 5:
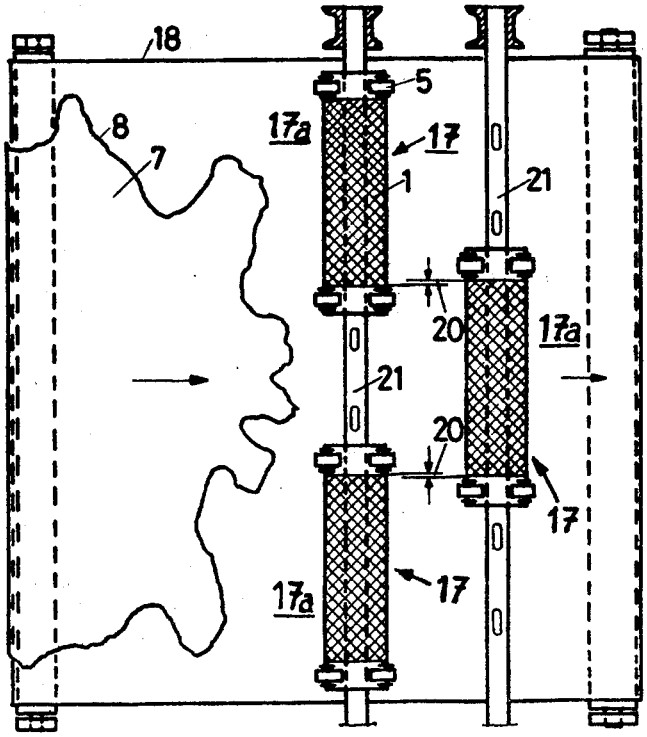
FIG. 5 is a top plan view of the leather working machine shown in FIG. 5*a* with an arrangement of staggered embossing or ironing stations for entire skins or hides.

An advantageous variant construction of machine for the embossing of, for instance, entire skins or hides 8 having working widths exceeding 3 meters has been shown in FIGS. 5 and 5a. The entire working width is divided over for instance three work zones 17a having three separate embossing stations 17 extending at least over the surface 7 of the leather or leather pieces 8. Each embossing station 17 comprises a relatively short tubular-shaped embossing element 1 which is supported by contact or bearing rolls 5 and an associated counter-pressure roll 10. At least certain of the embossing stations 17 are arranged behind one another in the direction of transport of the work pieces i.e. leather pieces 8 in such a manner that by means of the depicted overlapping regions 20 the staggered arrangement of embossing stations 17 cover the entire working width of the machine. The overlapping regions 20, which are present during the working operation, have no appreciable significance, because also during the operation of classical upright pressing embossing machines working with embossing plates there are formed a number of overlapping regions. The individual embossing stations 17 of this embodiment are arranged in common machine frame 24. It is necessary to appropriately synchronize the drive of the individual counter-pressure rolls 10, for instance by means of the drive chains 27 driven by drive motor 22. In this instance it is possible to use for the transport of the leather pieces 8 a single felt transport band or belt 18 which travels through all of the embossing stations 17. This constructional embodiment as shown in FIGS. 5 and 5a, has the advantage that there can be employed relatively short tubular-shaped leather working or embossing elements 1, so that the handling thereof during exchange or replacement operations and also the actual fabrication of such short embossing elements is more advantageous that when having to use elements exceeding 3 meters in length.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A throughpass embossing and ironing machine for processing leather pieces moving in a predetermined direction of travel comprising:

at least one substantially tubular-shaped thick-walled embossing or ironing element having opposed ends and an outer surface including an embossing or ironing zone;

at least one of said opposed ends being devoid of a central journal;

said embossing or ironing element having at each of its opposed ends externally of the embossing or ironing zone substantially cylindrical contact surfaces at the outer surface thereof;

means for exerting embossing or ironing forces at said cylindrical contact surfaces at said outer surface of said embossing or ironing element;

said embossing or ironing zone transmitting the embossing or ironing forces to the surface of a leather piece processed by the machine;

and elastic support means and at least one counter-pressure roll for supporting and transporting the leather pieces processed by the machine.

2. The machine as defined in claim 1, wherein:

said means for exerting said embossing or ironing forces comprises rolls.

3. The machine as defined in claim 1, wherein:

said means for exerting said embossing or ironing forces comprises open rolling-contact bearing means

4. The machine as defined in claim 1, wherein said tubular-shaped embossing or ironing element has an internal compartment;

means mounting said embossing or ironing element for rotation about a predetermined axis of rotation;

contact rolls each having an axis of rotation arranged within said internal compartment such that their axes of rotation extend transversely with respect to said axis of rotation of said embossing or ironing element;

said contact rolls serving for the support and transport of said embossing or ironing element during rapid exchange thereof.

5. The machine as defined in claim 1, wherein:

said means for exerting said embossing or ironing forces are movably arranged at said tubular-shaped embossing or ironing element.

6. The machine as defined in claim 5, wherein: said movably arranged means for exerting said embossing or ironing forces are displaceably arranged at said tubular-shaped embossing and ironing element.

7. The machine as defined in claim 5, wherein:

said movably arranged means for exerting said embossing and ironing forces are arranged to be tiltable at said tubular-shaped embossing and ironing element.

8. The machine as defined in claim 1, wherein:

said contact surfaces of said tubular-shaped embossing or ironing element comprise exchangeable ring members.

9. The machine as defined in claim 1, further including:

pressure rolls for pressing the counter-pressure roll against the tubular-shaped embossing or ironing element.

10. The machine as defined in claim 9, further including:

hydraulic pressure means for urging the pressure rolls against said counter-pressure roll.

11. The machine as defined in claim 10, wherein:

said pressure rolls exert a pressure against the counter-pressure roll in a work position thereof which causes bending-through of the tubular-shaped embossing or ironing element and said counter pressure roll in one direction.

12. The machine as defined in claim 1, wherein:

said counter-pressure roll has a smaller moment of resistance and static moment of inertia than said tubular-shaped embossing or ironing element.

13. The machine as defined in claim 1, wherein:

a plurality of individual ones of said tubular-shaped embossing or ironing elements and cooperating counter-pressure rolls for forming a respective number of embossing or ironing stations when processing leather pieces having a relatively large working width;

each said embossing or ironing element and its cooperating counter-pressure roll defining one such embossing or ironing station;

said plurality of embossing or ironing stations being mutually offset both with respect to the direction of travel of the leather pieces and transversely thereto in order to cover the entire working width of the leather pieces to be processed; and drive means for mechanically synchronizing all of the counter-pressure rolls.

14. The machine as defined in claim 13, wherein:

said drive means comprise chain means.

15. The machine as defined in claim 13, wherein:

said plurality of embossing or ironing stations define three stations for a given working width of the leather pieces to be processed.

16. The machine as defined in claim 13, wherein:

said elastic support means comprises a common elastic transport band provided for all of the embossing or ironing stations and extending between said tubular-shaped embossing or ironing elements and said counter-pressure rolls.

17. A throughpass leather working machine, especially an embossing or ironing machine for leather comprising:

at least one substantially tubular-shaped leather working element having opposed ends and an outer surface including a leather working zone;

said leather working element being devoid of any central bearing means at least at one end thereof in order to enable axial displacement of the leather working element for replacement purposes;

said leather working element having at each of its opposed ends externally of the leather working zone contact surfaces at the outer surface of said leather working element;

means for applying leather working forces at said contact surfaces at the outer surface of said leather working element;

said leather working zone transmitting the leather working forces to the surface of a leather piece processed by the machine; and elastic support means and at least one counter-pressure roll for supporting and transporting the leather pieces processed by the machine.

* * * * *